US009167354B2

(12) United States Patent
Nowak

(10) Patent No.: US 9,167,354 B2
(45) Date of Patent: Oct. 20, 2015

(54) ELECTROACOUSTIC SOUND TRANSDUCER

(75) Inventor: Alexander Nowak, Hannover (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 264 days.

(21) Appl. No.: 13/415,296

(22) Filed: Mar. 8, 2012

(65) Prior Publication Data

US 2012/0230522 A1 Sep. 13, 2012

(30) Foreign Application Priority Data

Mar. 9, 2011 (DE) ..... 10 2011 005 276

(51) Int. Cl.

| | |
|---|---|
| ***H04R 9/08*** | (2006.01) |
| ***H04R 1/00*** | (2006.01) |
| ***H04R 19/04*** | (2006.01) |
| ***H04R 19/02*** | (2006.01) |
| *H04R 19/01* | (2006.01) |
| *H04R 31/00* | (2006.01) |

(52) U.S. Cl.

CPC ..... *H04R 19/04* (2013.01); *H04R 19/02* (2013.01); *H04R 19/01* (2013.01); *H04R 31/00* (2013.01)

(58) Field of Classification Search

USPC ..... 381/174, 175; 438/50

See application file for complete search history.

(56) References Cited

U.S. PATENT DOCUMENTS

| | | | | |
|---|---|---|---|---|
| 4,258,235 | A * | 3/1981 | Watson | 381/174 |
| 5,870,482 | A * | 2/1999 | Loeppert et al. | 381/174 |
| 6,111,966 | A | 8/2000 | Staat et al. | |
| 2004/0259286 | A1 * | 12/2004 | Dehe et al. | 438/50 |
| 2007/0222006 | A1 | 9/2007 | Weber et al. | |
| 2008/0192963 | A1 * | 8/2008 | Sato | 381/174 |
| 2009/0214062 | A1 * | 8/2009 | Reining | 381/184 |
| 2011/0075863 | A1 | 3/2011 | Rosen et al. | |

FOREIGN PATENT DOCUMENTS

| | | |
|---|---|---|
| DE | 23 28 999 | 1/1974 |
| DE | 197 15 365 | 10/1998 |
| DE | 10 2006 004 287 | 8/2007 |
| WO | WO 2009/112241 | 9/2009 |

OTHER PUBLICATIONS

T. Alajoki et al., "In-mould integration of electronics into mechanics and reliability of overmolded electronic and optoelectronic components." Onlu, Finland, Jun. 2009; pp. 1-6.

* cited by examiner

*Primary Examiner* — Duc Nguyen
*Assistant Examiner* — Phan Le
(74) *Attorney, Agent, or Firm* — Frommer Lawrence & Haug LLP

(57) ABSTRACT

The electroacoustic transducer according to the invention has at least one diaphragm and at least one counterelectrode. In that case the diaphragm and/or the counterelectrode each have at least two electrically mutually insulated segments. In that arrangement the segments are so adapted that different electric signals are supplied or that different electric signals are delivered in response to exposure to sound of the sound transducer.

10 Claims, 9 Drawing Sheets

Upol = Polarisationsspannung

ELECTROACOUSTIC SOUND TRANSDUCER

The present application claims priority from German Patent Application No. DE 10 2011 005 276.3 filed on Mar. 9, 2011, the disclosure of which is incorporated herein by reference in its entirety.

BACKGROUND OF THE INVENTION

1. Field of the Invention

The invention concerns an electroacoustic sound transducer comprising a diaphragm and a counterelectrode arranged at a small spacing relative to the diaphragm.

It is noted that citation or identification of any document in this application is not an admission that such document is available as prior art to the present invention.

A capacitive sound transducer operating on the basis of the principle of the a condenser or condenser microphone has a diaphragm or electrode movable by the sound and a counterelectrode parallel thereto at a small spacing therefrom. In particular the diaphragm is frequently in the form of a thin metal film or an insulating film with a vapor-deposited metal layer thereon and can be electrically biased in relation to the counterelectrode. With that configuration the diaphragm and the counterelectrode form an electric condenser whose capacitance is dependent on the diaphragm deflection caused by the sound. If now an electric voltage is applied to the condenser of that structure the acoustic excitation of the diaphragm leads to a change in capacitance (due to a movement of the electrodes towards or away from each other), to a current between the electrically connected components diaphragm and counterelectrode and thus a change in voltage between the electrically connected components diaphragm and counterelectrode.

Such a condenser microphone is known for example from DE 197 15 365.

As state of the art attention is directed to DE 23 28 999 C3, DE 10 2006 004 287 A1, WO 2009/112241 A1 and Alajoki, T.: "In-mould integration of electronics into mechanics and reliability of overmolded electronic and optoelectronic components."

To reduce non-linearities by virtue of the compressible volume of fluid between the diaphragm and counterelectrode it is also known in particular to provide the counterelectrode with holes for compensating for fluctuations in the fluid pressure in that volume. Thus the mechanical biasing of the diaphragm is the most important parameter for the return force acting on the diaphragm after deflection by an applied sound pressure.

What is common to the sound transducer devices known in the state of the art which operate in accordance with the above-described principle is that they take off a single-electric signal between the diaphragm and the counterelectrode or apply an electric signal to the electrode pair formed from the diaphragm and the counterelectrode in order to emit sound by way of the sound transducer (loudspeaker).

Accordingly hitherto comparatively close limits have been set on the influence on the characteristics of the capacitive sound transducer. For example to produce a directional characteristic in respect of the incoming or emitted sound, acoustically operative passages and cavities were required in order to be able to produce different sound pressures in dependence on the relative position of the sound transducer relative to the sound field or to produce different microphonic sensitivities.

FIG. 1A shows a diagrammatic view in section of a sound transducer 1 according to the state of the art, which is constructed in the manner of a condenser microphone. A diaphragm 20 is stretched over a diaphragm support 5, in the lower region of which there is in turn a counterelectrode 30. An electric signal between diaphragm 20 and counterelectrode 30 can be taken off by way of electric connections 40, 41. Counterelectrodes known in the state of the art are substantially to be viewed as electrically homogenous electrodes, but frequently have acoustically operative holes 34 passing therethrough in order to ventilate the pressure chamber between the diaphragm 20 and the counterelectrode 30. The fixing means between diaphragm 20 and diaphragm support 5 can be of such a configuration, as shown, that the mechanical biasing of the diaphragm 20 can be adjusted by means thereof (for example by turning a thread-like structure).

For emitting different signals at the same time it was also necessary for them to be already electrically mixed prior to the sound transducer or its signal inputs being acted upon. Otherwise, parallel operation of two amplifiers at a sound transducer would lead to distortion of the signals or damage to the amplifiers. However, mixing of the signals prior to the sound transducer being acted upon requires suitable structural units or generally digitally implemented functional units which are not always present per se and which in addition involve weight and the risk of a malfunction. Particularly when mixing a useful signal with a correction signal as is generated for example in devices for active noise compensation (ANC), the delays occurring in signal processing are a parameter known to be critical for applicability of the structure or algorithm employed.

FIG. 1B shows a diagrammatic sectional view of a sound transducer according to the state of the art. The acoustic sound transducer 1 has two diaphragms 20 and two counterelectrodes 30. The two diaphragms 20 and the counterelectrodes 30 are provided at opposite ends of the sound transducer so that the sound transducer can have two separate transducers.

It is noted that in this disclosure and particularly in the claims and/or paragraphs, terms such as "comprises", "comprised", "comprising" and the like can have the meaning attributed to it in U.S. Patent law; e.g., they can mean "includes", "included", "including", and the like; and that terms such as "consisting essentially of" and "consists essentially of" have the meaning ascribed to them in U.S. Patent law, e.g., they allow for elements not explicitly recited, but exclude elements that are found in the prior art or that affect a basic or novel characteristic of the invention.

It is further noted that the invention does not intend to encompass within the scope of the invention any previously disclosed product, process of making the product or method of using the product, which meets the written description and enablement requirements of the USPTO (35 U.S.C. 112, first paragraph) or the EPO (Article 83 of the EPC), such that applicant(s) reserve the right to disclaim, and hereby disclose a disclaimer of; any previously described product, method of making the product, or process of using the product.

SUMMARY OF THE INVENTION

An object of the invention is to circumvent the aforementioned disadvantages. In particular the invention seeks to provide an electroacoustic transducer which can be used in flexible and versatile fashion. In addition the invention seeks to provide such an electroacoustic transducer in an inexpensive structure suitable for mass production.

The electroacoustic transducer according to the invention has at least one diaphragm and at least one counterelectrode. In that case the diaphragm and/or the counterelectrode each have at least two electrically mutually insulated segments. In that arrangement the segments are so adapted that different electric signals are supplied or that different electric signals are delivered in response to exposure to sound of the sound transducer.

In an aspect of the invention in that case the diaphragm can either comprise the electrode itself which in that case is produced in the form of a thin metal element, in the manner of a film, or can also include a carrier or a carrier material, to which an electrically conducting layer has been applied. As the diaphragm couples the forces acting thereon to the sound field its oscillatory properties, that is to say stiffness, damping and mass are generally of higher relevance than those of the counterelectrode which generally does not perform any acoustic oscillations of amplitudes worth mentioning.

In an aspect of the invention only the counterelectrode or also the counterelectrode has at least one and preferably at least two electrically conducting segments which are not relevant in terms of oscillation characteristics depending on the respective configuration of the counterelectrode. Accordingly the counterelectrode or the segment arranged thereon can be mechanically markedly more massive and more robust in comparison with the segment arranged on the diaphragm and from time to time may be acted upon in terms of mechanical parameters with greater tolerances.

Both in the situation where the electrically mutually insulated segments are arranged on the diaphragm and also in the situation where the mutually insulated segments are arranged on the counterelectrode it is provided according to the invention that in each case a segment of the diaphragm can be occupied with an electric signal in relation to at least one segment (if present) of the counterelectrode or the counterelectrode as a whole or a segment of the counterelectrode can be occupied with an electric signal in relation to at least one segment (if present) of the diaphragm or the diaphragm as a whole. For that purpose preferably electric connections are provided on each segment and at the electrode opposite the segment (or the segments of the electrode) and are taken out of the electroacoustic transducer.

Preferably the segments of the at least one diaphragm and/or the at least one counterelectrode are arranged on a surface that is towards the counterelectrode or the diaphragm respectively. In that way the electrically operative spacing between the electrically operative components of the sound transducer is reduced and thus its sensitivity is improved.

In order not to risk damage to the electric components or the electric and electronic peripheral units such as for example the signal processing means in the event of a collision between diaphragm and counterelectrode it can be provided that the electrically conducting components are additionally covered with an insulating means and are thus electrically insulated.

To reduce the height of the electric sound transducer and to save on material and weight, it can be provided that the electrodes or segments are produced in the form of thin electrically conducting layers in the manner of a film, in particular by vapor deposition of a metal, in particular on an electrically insulating carrier.

In an aspect of the invention the segments of an electrode are arranged in the form of concentric circular disks or annular disks. For example the inner segment can be in the form of a circular disk while a segment arranged therearound in the form of an annular disk. It will be appreciated that it is also possible to envisage further segments arranged around that second segment, for example also in annular disk form.

The annular or circular disks can also be subdivided into further segments, in which sectors of those annular or circular disks are arranged insulated relative to each other and are respectively adapted to be individually contactable.

In accordance with the invention the segments are arranged in the manner of a chessboard or in matrix form. Particularly in the situation where the counterelectrode has segments arranged in matrix form, they can preferably be contacted from the rear side of the carrier of the counterelectrode. It will be understood that a matrix arrangement affords a particularly high degree of flexibility in use and actuation of the electric sound transducer according to the invention. On the one hand that permits highly precise influencing of the form of oscillation of the diaphragm while on the other hand actuation of forms of oscillation which were not possible hitherto can be produced, with a suitable mechanical design configuration.

In an aspect of the invention of the electric sound transducer according to the invention the sound transducer is a condenser microphone, an electret microphone or an electrostatic loudspeaker. While the foregoing discussion already referred to the principle of a condenser microphone the biasing of the electrodes of the sound transducer in the case of the electret microphone, instead of being by an electric voltage applied from the exterior, can be implemented by an electret, that is to say a material having an inherent electric voltage.

In a further aspect of the invention the segments are arranged on the counterelectrode and the counterelectrode is produced on a carrier material in the form of a molded interconnected device (MID). That recent production process affords a comparatively high degree of design freedom and automatability. Those electronic components which are referred to in German as "injection-molded circuit carriers" can also have acoustically operative structures if of a suitable design configuration, over and above the electric or electronic properties. In particular enhanced environmental friendliness and also a considerable rationalization potential in the production of sound transducers according to the invention is an aspect in favor of a production process using the MID technology.

If a production process using the MID technology cannot be considered it is also possible to use conventional circuit board material for production of the counterelectrode of an electroacoustic transducer according to the invention. In that case, conductive elements applied using known manufacturing methods can be provided as the segment of the counterelectrode. Those segments can also either be contacted from the rear side of the circuit board or for example by virtue of a multi-layer structure involving electrically conducting layers and insulating means therebetween. In particular counterelectrodes of a layered structure, in the mass production of electroacoustic transducers according to the invention, can be produced by the use of suitable masks or templates for applying the individual layers.

If the electric sound transducer is constructed in the manner of an electret microphone individual segments can be electrically biased to differing degrees by the arrangement of different electret amounts, concentrations and/or materials. Selection of the electret amount, concentration or electret materials makes it possible to influence the rest position of the diaphragm. That influence represents in particular an indirect influence because the diaphragm has a tendency to involve a deflection as soon as there is an electrostatic field (due to the electret). Typically the severest deflection of the diaphragm will occur in the center thereof. Accordingly here too there is the greatest risk that the diaphragm comes into contact with the counterelectrode or other components so that the diaphragm is blocked in those situations. Preferably the sound transducer should be so designed that mechanical contact of the diaphragm with other components of the sound transducer is just prevented. That is particularly advantageous in regard to enhanced sensitivity. According to the invention the counterelectrode can be subdivided into an inner portion involving a less strong field and an outer portion with a strong field. In that case it is possible to achieve a higher field strength, with deflection of the diaphragm which as far as possible is the same, and thus a higher level of sensitivity.

In a further aspect of the invention the electric sound transducer is used in a sound transducer assembly, wherein the sound transducer assembly has in particular means for electrically biasing segments of the diaphragm and/or counterelectrode and for mixing or processing, delaying, filtering, amplifying, digital-analog conversion and/or analog-digital conversion of electric signals. Such a sound transducer assembly according to the invention can include at least one electric sound transducer according to the invention and can be designed and adapted for many different uses. A possible arrangement is the recording of sound by a sound transducer assembly in the manner of a microphone, wherein the signals recorded by different segments are added in conventional manner, but on the other hand can also be outputted as a difference signal for the production for example of a directional characteristic for the microphone. In that case transit time differences between the incoming sound events at the segments involve time differences in the resulting signals which in dependence on the angle of incidence lead to superimposition and extinction effects.

A further situation of use is a sound transducer equipped with active noise cancellation (ANC) and which in turn emits a useful signal, but at the same time a correction signal produced by an interference sound microphone for reducing the influence of the interference sound on the auditory experience of the listener. Segmentation according to the invention either of the diaphragm or the counterelectrode or both components eliminates the need for the signals to be previously electrically mixed for emission by way of a common diaphragm.

In an aspect of the invention the sound transducer assembly according to the invention has the means required for appropriate use, in particular a voltage source, a digital or analog device for mixing or processing the signals, a digital or analog delay member, digital or analog filter means such as for example an RC member or network, a pre-amplifier and a D/A or A/D converter. In that way the complexity required in respect of the peripheral devices and tuning of the included components, that is required for proper functioning, can for example already be effected at the manufacturer.

In a further aspect of the invention there is provided a method of electric sound transduction, wherein an acoustic transducer such as for example a diaphragm is moved by means of two different electric forces acting thereon. In that case according to the invention the forces are produced by electric signals of differing potential, which can be applied to electrically mutually insulated means. Electric forces impressed in that way act in particular on different regions of the acoustic transducer. According to the above-described method it is possible for example to operate a loudspeaker constructed in the manner of a condenser.

In a further aspect of the invention there is provided a method of electric transduction, wherein an acoustic transducer, for example a diaphragm, produces different electric signals by means of exposure to sound. According to the invention those electric signals can be taken off at electrically mutually insulated means. According to the afore-described method for example it is possible to operate a microphone constructed in the manner of a condenser. In that respect it is possible for the electrically mutually insulated means to be biased to differing degrees in relation to an opposite electrode or to apply to the means different signals designed for biasing purposes. Those signals can for example also be implemented by feedback to the sound transducer according to the invention of incoming signals.

The underlying idea of the present invention is that, by means of two adjacent electrodes of which at least one is in the form of a diaphragm, a plurality of electric signals can be impressed in that way at the same time on the sound transducer or can be taken therefrom, by the acoustic transducer and/or a counterelectrode associated therewith having a plurality of electrically mutually insulated segments.

In practice there is often a wish to develop a microphone which is as flexible as possible, that is to say to permit adaptation to be implemented by the user in respect of sensitivity, frequency response and directional effect. In order for example to produce a variable directional effect for a microphone, it is possible to use either two separate capsules or a so-called dual diaphragm system. In the dual diaphragm system, it is possible to use two acoustic transducers which both have a cardioid characteristic and which are connected together in the center by way of an acoustic resistance. In that case both halves of the system are disposed in a housing. Any directional effects can now be produced from two signals by suitable electric switching of the capsule signals.

The invention concerns the notion that the property of the switchable directional effect of a dual system is to be achieved with only one capsule, by virtue of subdivision of the counterelectrode and/or diaphragm into segments. For that purpose the second (rear) system of the dual diaphragm system is integrated into the first (front) system. That can be effected for example by segmenting the counterelectrode and by individually passing out the electric signals for further signal processing. That therefore affords a microphone having a coaxial arrangement with only one reference point, namely the diaphragm. In order now to obtain the necessary items of information for directional effect production, the segments are acoustically separated from each other. That can be effected for example by means of a shape as shown in FIG. 4B. Here the air is passed through the holes in the central portion of the counterelectrode into a closed rearward volume. That results in a signal which is free of items of directional information, that is to say an omnidirectional characteristic. The second segment can serve for determining the items of directional information. Here there is a rearward inlet which is intended to make it possible for the diaphragm to be deflected by the pressure difference, that is to say a bidirectional characteristic. It is now possible to produce any directional effects from two signals by suitable electric switching of the capsule segments. The advantage is a simple structure, less material, lower costs and flat constructions. The disadvantage is that changes in the frequency response when switching over the directional effect are not to be ruled out.

DETAILED DESCRIPTION OF EMBODIMENTS

Figure 1A:
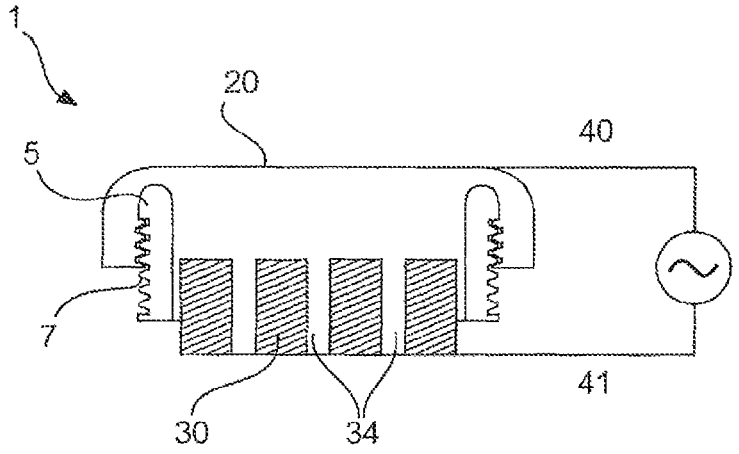
FIG. 1A shows a diagrammatic sectional view of a sound transducer 1 according to the state of the art, constructed in the manner of a condenser microphone.
Figure 1B:
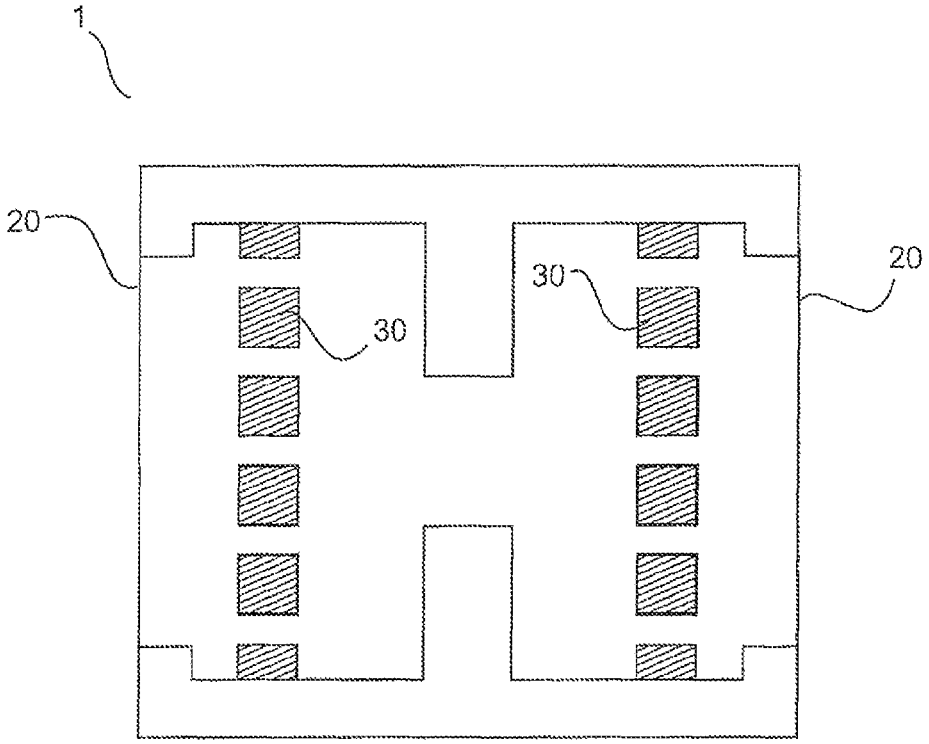
FIG. 1B shows a diagrammatic sectional view of a sound transducer according to the state of the art.

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments.

In the following specific description mutually corresponding items are denoted by the same reference characters or numerals for the sake of clarity, to correspond to the reference numerals used in the accompanying Figures. References to the Figures like "left", "right", "up", and "down" refer to an orientation of the Figures with the reference numerals or characters being normally readable.

According to the invention the electroacoustic sound transducers can represent high-grade sound transducers such as for example microphones. The diameter of a diaphragm of the microphone is optionally greater than or equal to 0.5 inch (about 127 cm).

Figure 2:
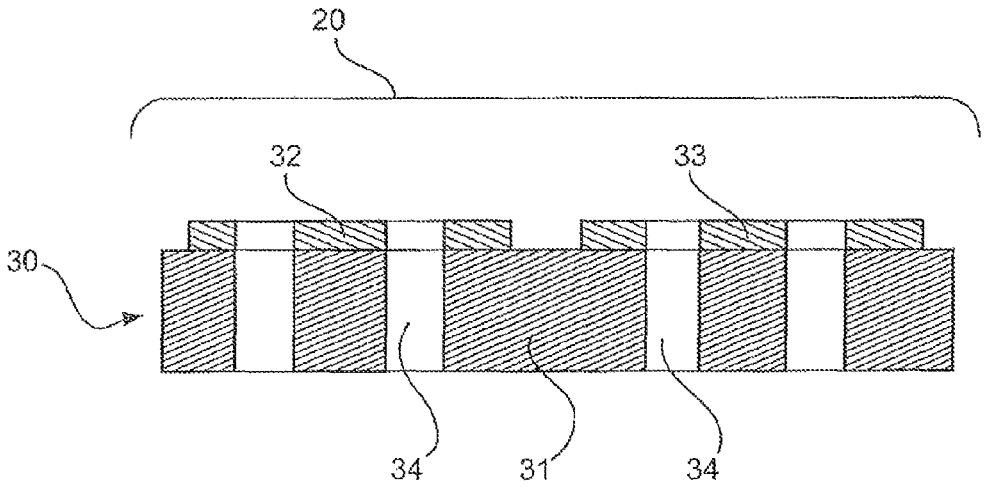
FIG. 2 shows a diagrammatic sectional view of a counterelectrode according to the first embodiment.

FIG. 2 shows a diagrammatic sectional view of a counterelectrode according to the first embodiment. The counterelectrode 30 has two counterelectrode segments 32, 33 which are not electrically connected together, that is to say which are electrically insulated from each other. Both counterelectrode segments 32, 33 are arranged in mutually juxtaposed relationship on a counterelectrode carrier 31. They are electrically contacted separately from each other and can each be electrically biased in relation to the diaphragm 20 (in the same or differing fashion). Acoustically operative holes 34 pass through the counterelectrode carrier 31 and the counterelectrode segments 32, 33. For the sake of clarity of the drawing the diaphragm support 5 and the electric connections 40, 41 are not shown.

Figure 3:
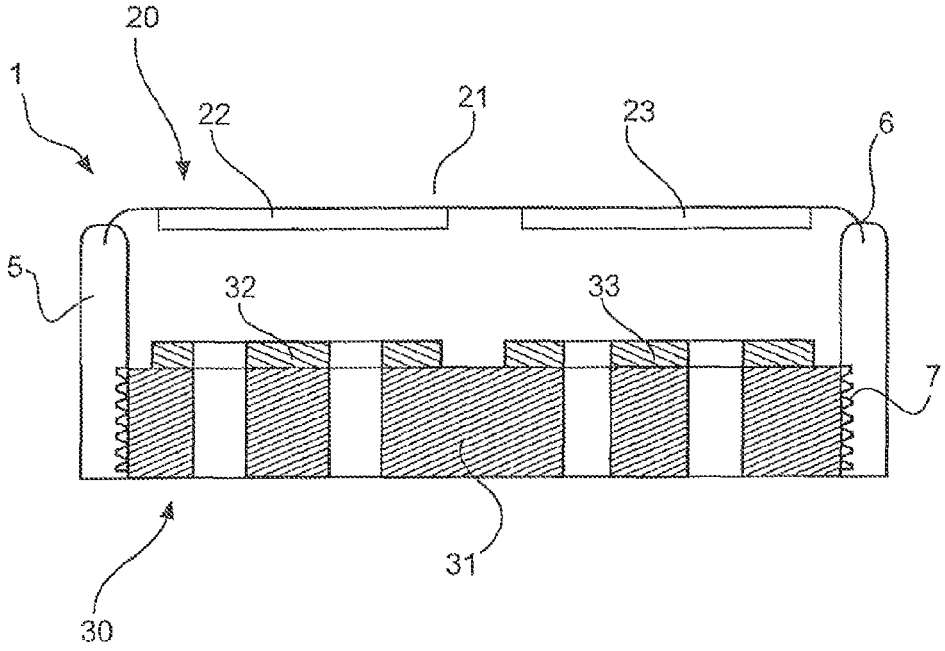
FIG. 3 shows a diagrammatic sectional view of an electroacoustic transducer according to the second embodiment.

FIG. 3 shows a diagrammatic sectional view of an electroacoustic transducer according to the second embodiment. The transducer 1 has a diaphragm 20 and a counterelectrode 30. The diaphragm 20 has diaphragm segments 22, 23 arranged in mutually electrically insulated relationship in mutually juxtaposed relationship on a diaphragm carrier 21. The diaphragm 20 is connected to a diaphragm support 5 by way of first fixing means 6. Disposed in the lower region of the diaphragm support 5 is a counterelectrode carrier 31 connected to the diaphragm support 5 by way of second fixing means. The counterelectrode segments 32, 33 already discussed in connection with FIG. 2 are disposed also on the top of the counterelectrode 30. The separate electric connections for the diaphragm segments 22, 23 and the counterelectrode segments 32, 33 are not shown in this view.

If the arrangement shown in FIG. 3 is operated as a loudspeaker or sound emitter then the diaphragm segments 22, 23 can be acted upon with a signal, in relation to the counterelectrode segments 32, 33. According to the invention it is also possible for example for the tappings of the diaphragm segment 22 and the counterelectrode segment 32 to be acted upon with a first signal while diaphragm segment 23 and counterelectrode segment 33 are acted upon with a second signal by way of respective tappings. That results in different forces in particular on the diaphragm segments 22 and 23 in dependence on the signals, and those forces in turn lead to different deflections of the diaphragm surface portions covered by them. It will be appreciated that it is also possible for the electric connections of the diaphragm segments 22 and 23 to be electrically connected together whereby the above-described signals are applied in relation to a common reference potential. A corresponding consideration applies to a possible connection of the electric connections of the counterelectrode segments 32 and 33.

It will also be seen when viewing FIGS. 2 and 3 in combination that it is also possible for only the diaphragm 20 to be equipped with mutually insulated diaphragm segments 22, 23 while the counterelectrodes 30, instead of the counterelectrode segments 32, 33 shown in FIGS. 2 and 3, could have only one single electrically operative surface, by the illustrated counterelectrode segments 32 and 33 not being mutually electrically insulated as shown.

Figure 4A:
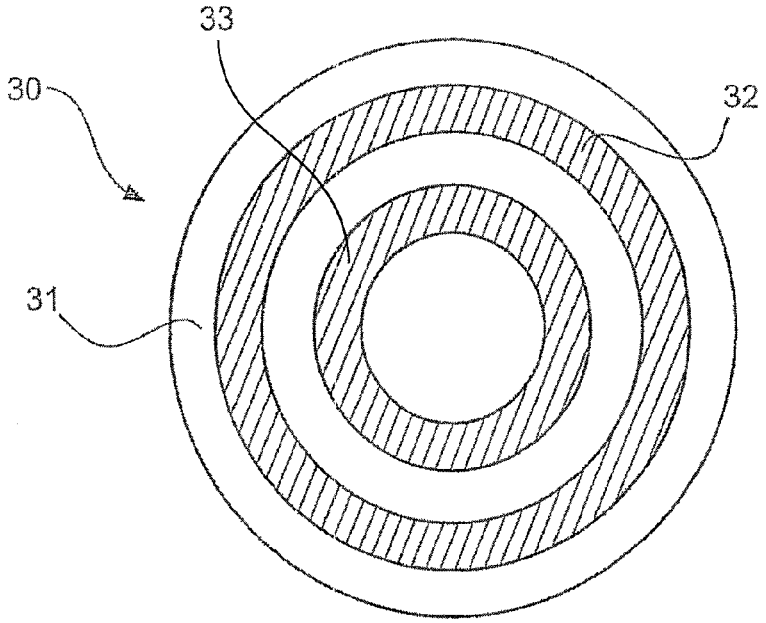
FIG. 4A shows a diagrammatic plan view of a counterelectrode according to the third embodiment.

FIG. 4A shows a diagrammatic plan view of a counterelectrode according to the third embodiment. The counterelectrode 30 has at least two segments in respect of which the counterelectrode segments 32, 33 are concentric and are of an annular configuration. In this case the counterelectrode carrier 31 of the counterelectrode 30 is made from electrically insulating material so that signals applied to the counterelectrode segments 32, 33 cause locally different force effects, in relation to a diaphragm extending over the illustrated counterelectrode 30.

To alter the deflection of the diaphragm it is optionally possible to produce an electrostatic field and in addition thereto at least one further field is required on the opposite side of the diaphragm. That further field can be produced for example by way of a second counterelectrode or an electrically charged gauze. An electrically charged gauze is advantageous because it is acoustically less effective than a massively holed counterelectrode. As an alternative thereto it is also possible to use an acoustically operative resonator upstream of the microphone, the electrically charged gauze of which additionally produces an electrostatic field and can influence the oscillation characteristic of the diaphragm.

If a suitable regulating device is provided the forms of oscillation or modes of the diaphragm can also be influenced in specifically targeted fashion by actuation by means of a suitable change signal by way of one of the illustrated counterelectrode segments.

In a further example of the invention output signals of the various segments can be added. Parameters for the output signals can represent the polarization voltage and capacitance. A change in capacitance can be caused by switching segments off and/or on. Addition of the output signals of the segments can be effected in a microphone or outside a microphone on an analog or digital basis.

Figure 4B:
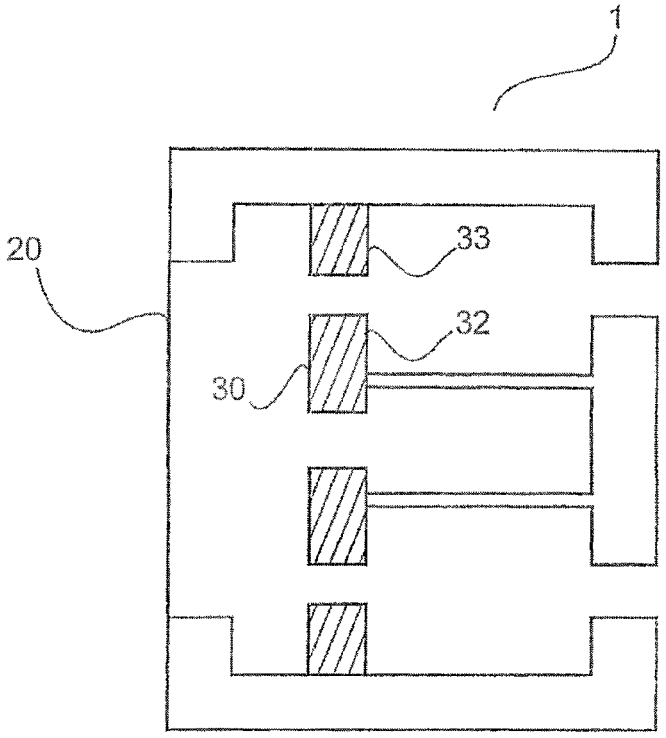
FIG. 4B shows diagrammatic sectional view of a sound transducer according to the third embodiment.

FIG. 4B shows a diagrammatic sectional view of a sound transducer according to the third embodiment. The sound transducer 1 of the third embodiment has a diaphragm 20 and a counterelectrode 30, wherein the counterelectrode has at least two counterelectrode segments 32, 33. In particular the sectional view in FIG. 4B can represent a sectional view of the counterelectrode shown in FIG. 4A.

Figure 4C:
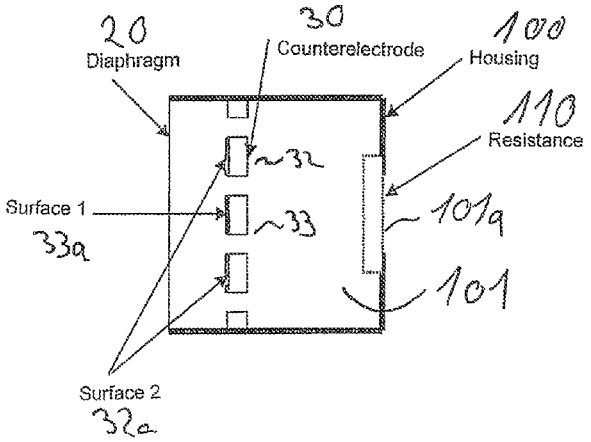
FIGS. 4C through 4F each show a diagrammatic sectional view of a sound transducer.

FIG. 4C shows a diagrammatic sectional view of a sound transducer. The sound transducer 1 has a diaphragm 20, a housing 100 and a counterelectrode 30. The counterelectrode has two segments 32, 33. The first segment 32 has a surface 32*a* at its side towards the diaphragm 20. The second segment 33 has a surface 33*a* at its side towards the diaphragm 20. An opening 100*a* with an acoustic resistance 110 can be provided on the side of the housing 100, opposite to the diaphragm 20. A volume 101 can be provided between the counterelectrode 30 and the acoustic resistance 110. The first and second surfaces 33*a*, 32*a* are electrically separated from each other. The directional action of the sound transducer can be altered with the sound transducer shown in FIG. 4C. The sound transducer of FIG. 4C has a capsule system comprising the diaphragm 20 and the counterelectrode 30. Sampling of the diaphragm oscillation at various points of the diaphragm can be effected with the segments 32, 33 and the associated surfaces 32*a*, 33*a* (subdivided counterelectrode).

Figure 4D:
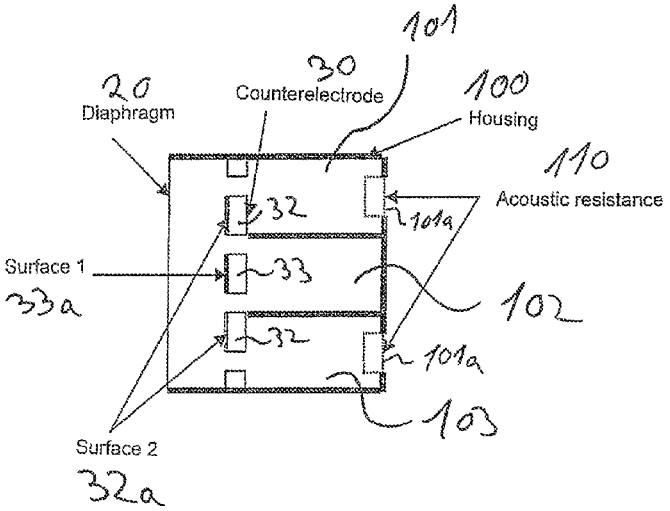

FIG. 4D shows a diagrammatic sectional view of a sound transducer. The sound transducer of FIG. 4D substantially corresponds to that shown in FIG. 4C. The difference between the two sound transducers of FIGS. 4D and 4C is that the sound transducer of FIG. 4D has a subdivision of the rear volume so that the rear volume has been subdivided into three smaller volumes 101, 102, 103. The acoustic resistance 110 is now provided at an opening 101*a* of the first rear volume 101 and the third rear volume 103.

Figure 4E:
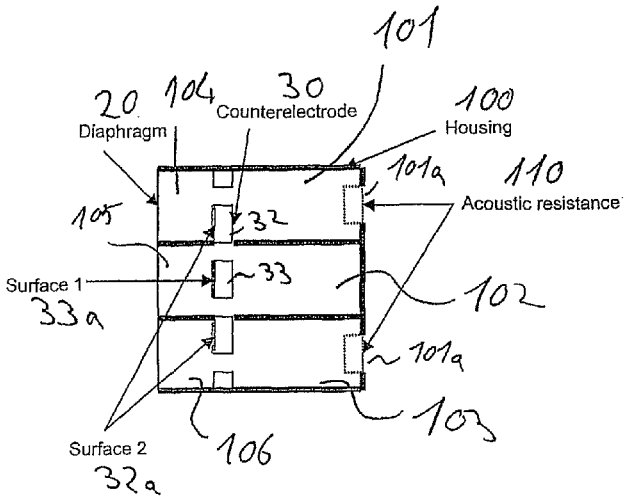

FIG. 4E shows a diagrammatic sectional view of a sound transducer. The sound transducer of FIG. 4E is essentially based on that of FIG. 4D and thus also involves subdivision of the rear volume. In addition thereto there is also subdivision of the front volume into three volumes 104, 105 and 106.

Figure 4F:
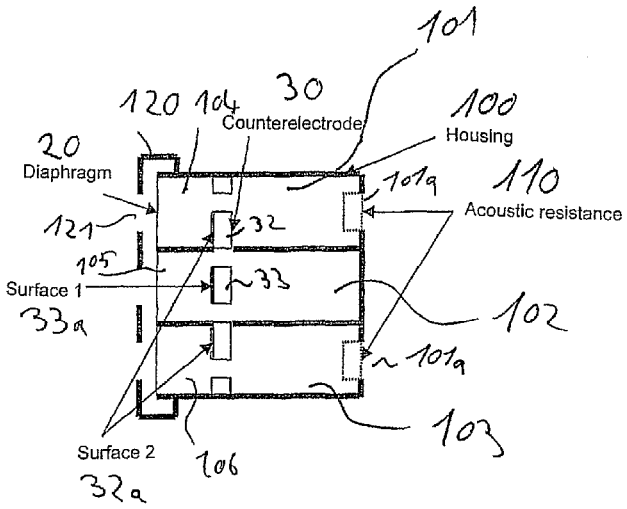

In the sound transducer of FIG. 4D and FIG. 4F two of the volumes 101, 103 have an acoustic resistance 110 so that they involve different damping of the individual volume portions.

FIG. 4F shows a diagrammatic sectional view of a sound transducer. The sound transducer of FIG. 4F is based on that shown in FIG. 4E. In addition thereto the sound transducer of FIG. 4F has optionally differently sized openings 121 in front of the diaphragm. The acoustic properties of the sound transducer can be further influenced by those openings.

The microphone according to the invention is preferably of a diameter of at least 0.5 inch (about 1.27 cm). Because of the size of the diameter of the diaphragm of the microphone of at least 0.5 inch the diaphragm has regions which oscillate differently. The electroacoustic sound transducers or microphones shown in FIGS. 4C through 4F make it possible to detect the oscillations of the diaphragm at various locations on the diaphragm. The effect of the differently oscillating regions of the diaphragm can be influenced in specifically targeted fashion for example by subdivision of the rear volume (behind the counterelectrode) and optionally by different damping of the individual volume portions of the rear volume. In the embodiment shown in FIGS. 4E and 4F it should be pointed out that the partitions in the volume between the diaphragm and the counterelectrode do not reach the diaphragm 20 so that the diaphragm 20 can oscillate freely.

Figure 5:
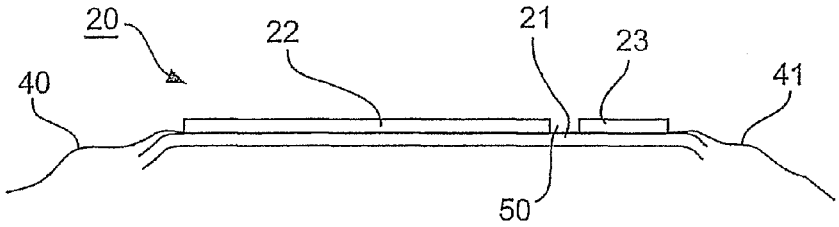
FIG. 5 shows a diagrammatic sectional view of a diaphragm according to a fourth embodiment.
Figure 7:
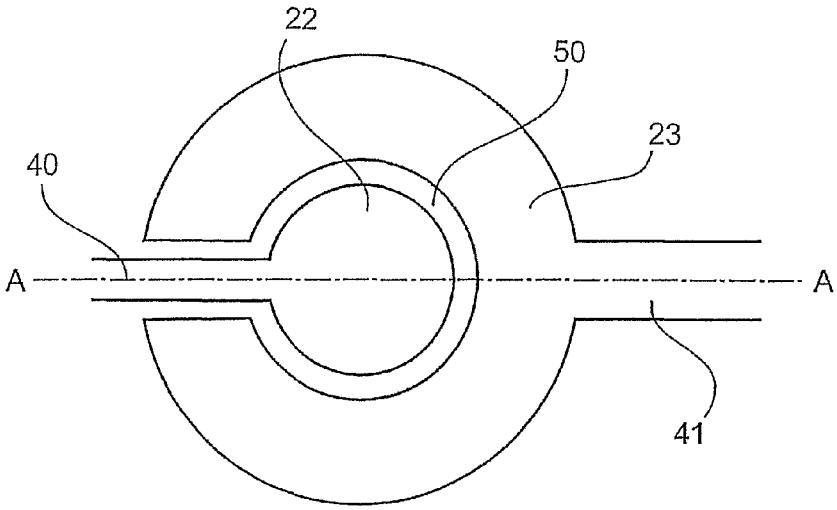
FIG. 7 shows a plan view of a diaphragm as shown in FIG. 6 of the present invention.

FIG. 5 shows a diagrammatic sectional view of a diaphragm according to a fourth embodiment. The diaphragm 20 has thin diaphragm segments 22, 23. The thin diaphragm segments are electrically insulated from each other by way of an insulating gap 50. They are arranged flat in mutually juxtaposed relationship on the diaphragm carrier 21 and can be electrically contacted by way of electric connections 40, 41. The sectional view shown in FIG. 5 could for example correspond to a possible view along sectional line A-A shown in FIG. 7. At the location shown at the left in FIG. 7, at which the diaphragm segment 22 virtually "breaks through" the outer diaphragm segment 23 electric insulation is not necessary insofar as a gap between the diaphragm segments 22 and 23 provides for the required high electric resistance. With the corresponding insulating gap 50 the diaphragm segments 22 and 23 also do not touch each other at the break-through location shown in FIG. 7.

Figure 6:
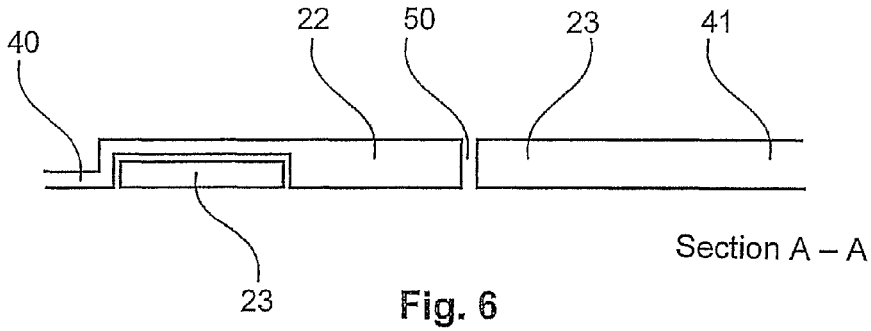
FIG. 6 shows a diagrammatic view of electric connections of a diaphragm segment according to a fifth embodiment.

FIG. 6 shows a diagrammatic view of electric connections of a diaphragm segment in a fifth embodiment. An annular diaphragm segment 23 is not completely interrupted here but is only of a flatter configuration. In other words it forms a kind of "ford" for passing over the segment region leading to the electrical connection 40 of the diaphragm segment 22. An insulating intermediate layer is disposed between the diaphragm segment 23 and the part, which is passed thereover, of the diaphragm segment 22 which ends in an electric connection 40. Thus FIG. 6 can also show a possible sectional view through the arrangement shown in plan in FIG. 7.

Figure 8:
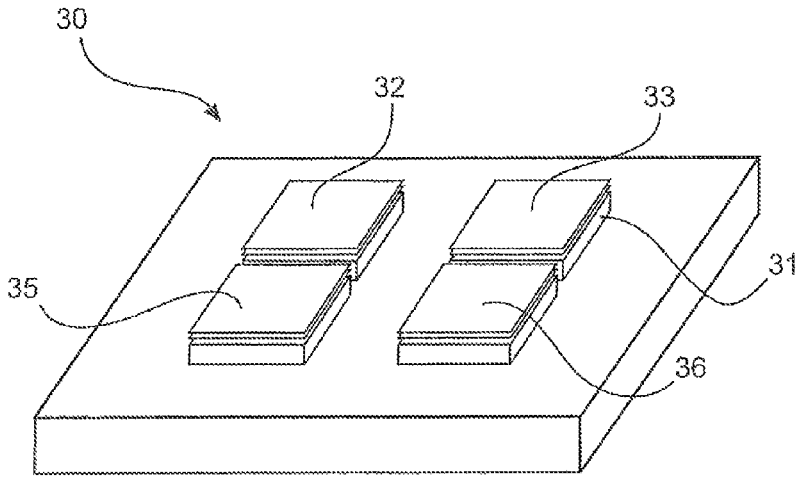
FIG. 8 shows a perspective view of an arrangement comprising four counterelectrode segments.

FIG. 8 shows a perspective view of an arrangement comprising four counterelectrode segments. The counterelectrode segments 32, 33, 35 and 36 are arranged on a counterelectrode carrier 31. The electrically conducting counterelectrode segments 32, 33, 35, 36 are arranged on platforms made of electrically insulating material of the counterelectrode carrier 31. In that arrangement the platforms can be of such a configuration that the passages between them have an acoustically advantageous effect, for example for guiding the fluid compressed by the diaphragm oscillation, such guidance being advantageous in terms of flow dynamics. Contacting of the counterelectrode segments 32, 33, 35, 36 can be effected for example by way of passages provided at suitable locations in the counterelectrode carrier 31 so that the connections are on the lower side of the counterelectrode carrier 31. Alternatively for example conductor tracks produced using layer technology can make the electric connection of the illustrated counterelectrode segments 32, 33, 35, 36 with the peripheral devices. They can for example also be designed in mutually superposed relationship by virtue of insulating layers between them (if required).

Figure 9:
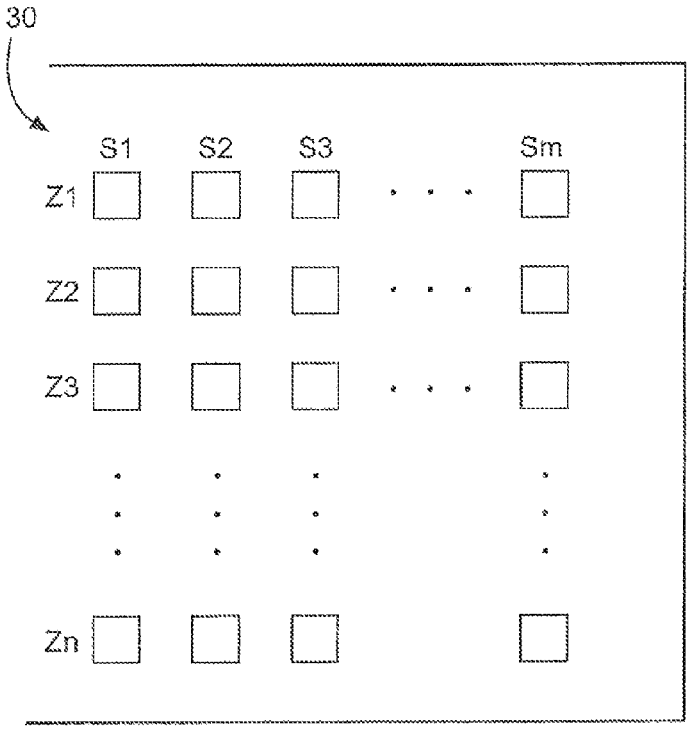
FIG. 9 diagrammatically shows a matrix arrangement of counterelectrode segments according to an eighth embodiment.

FIG. 9 diagrammatically shows a matrix arrangement of counterelectrode segments according to an eighth embodiment. The counterelectrodes S1 through Sm and Z1 through Zn respectively are disposed on a counterelectrode carrier. Similarly to the pixels of a display screen the illustrated counterelectrode segments, with a suitable arrangement of electric connections, can be supplied with signals completely independently of each other, with respect to a diaphragm disposed thereabove. Such signal supply could be afforded for example for the situations of use already mentioned and discussed hereinbefore, but in addition, by virtue of the multiplicity of and the distribution of the counterelectrode segments, it also affords the possible option of producing almost any force distributions on the diaphragm, as is used for example for applications in the manner of sound field synthesis. Thus, directional effects in the emission characteristics of the diaphragm can be achieved by suitable delays between adjacent counterelectrode segments. The number of possible rows (Z1 . . . Zn) and columns (S1 . . . Sm) is in that case set primarily by the mechanical properties of the diaphragm disposed thereabove. In accordance with the foregoing description relating to the MID production process, the counterelectrode segments shown in FIG. 9 can also be contacted from the direction of the rear side of the counterelectrode carrier and acted upon with signals therefrom.

Figure 10:
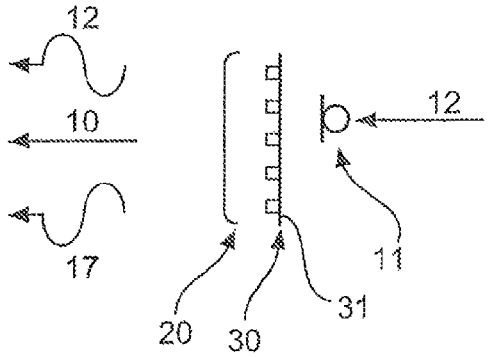
FIG. 10 shows a diagrammatic view of an interference sound reduction unit.

FIG. 10 shows a diagrammatic view of an interference sound reduction unit. The unit has an interference sound microphone 11, a counterelectrode 30 and a diaphragm. Interference sound 12 impinging on an interference sound microphone 11 from the right in the Figure is converted into an electric signal and same is possibly pre-processed for further use. In particular delay members are used here. A sound transducer known from the state of the art consisting of a diaphragm 20 and a counterelectrode 30 with a counterelectrode carrier 31 is provided for reproduction of the compensation signal generated from the interference sound 12. The compensation signal emitted by the diaphragm 20 is superposed at least at a predefined point with the interference sound 12, wherein the two signals cancel each other out in their effect. If the diaphragm 20 is additionally acted upon with a useful sound signal, that can be perceived or propagated in the form of useful sound 10 unimpaired by the interference sound. For reproduction of the useful sound signal and the compensation signal at the same time however electrical mixing of the two signals is required—as already stated—before being supplied to the loudspeaker.

Figure 11:
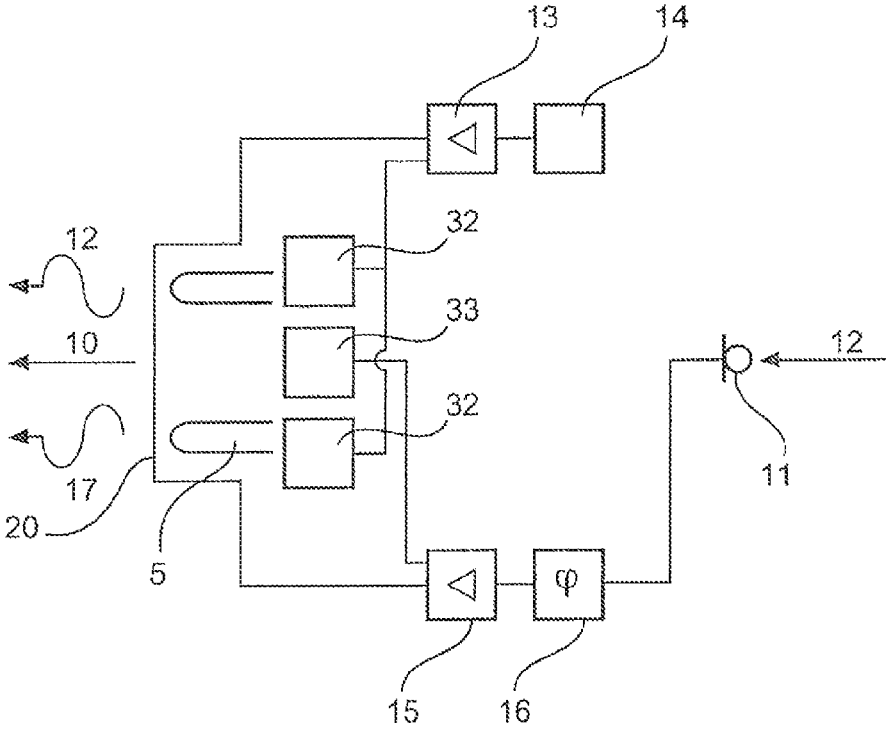
FIG. 11 shows a block circuit diagram of an interference sound compensation unit according to a ninth embodiment.

FIG. 11 shows a block circuit diagram of an interference sound compensation unit according to a ninth embodiment. The interference sound microphone 11 and the diaphragm 20 correspond to the components shown in FIG. 10, and likewise the signals interference sound 12, useful sound 10 and compensation signal 17. Interference sound 12 incident in the Figure from the right impinges on the interference sound microphone 11 and is there electrically converted for further processing in a delay member 16 and an amplifier 15. In comparison with the structure shown in FIG. 10 the counterelectrode of FIG. 11 according to the invention has two counterelectrode segments 32, 33. As can be seen the compensation signal generated from the interference sound 12 is only applied to the counterelectrode segment identified by reference 33.

The interference sound compensation unit has a useful signal source 14 from which a useful signal can be passed by way of an amplifier 13 to the diaphragm 20 and the counterelectrode segment 32. That is emitted in the form of useful sound 10 unimpaired by the interference sound 12 as the compensation signal 17 also emitted by the diaphragm 20 offsets the interference sound. It will be seen in comparison with the FIG. 10 structure that electric mixing of the compensation signal 17 and the useful signal from the useful signal source 14 does not occur. A compensation signal 17 and a useful signal are emitted electrically independently from each other by way of one and the same diaphragm 20 by mutually galvanically separated counterelectrode segments 32, 33.

Figure 12:
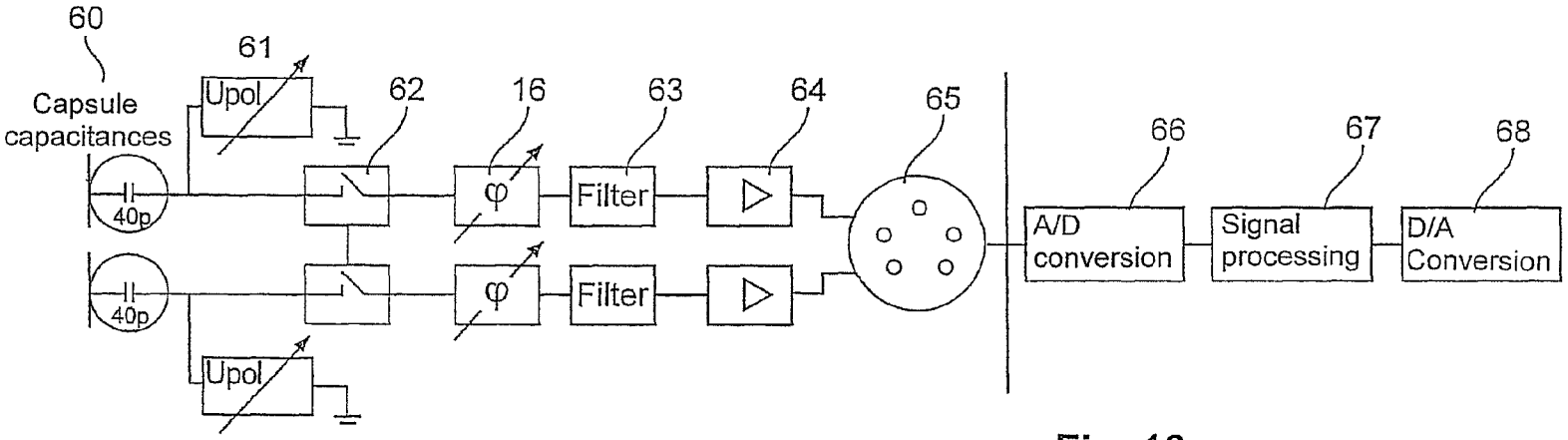
FIG. 12 shows a block circuit diagram for a condenser microphone having two counterelectrode segments according to a tenth embodiment.

FIG. 12 shows a block circuit diagram for a condenser microphone having two counterelectrode segments according to a tenth embodiment. In this case actual signal processing is effected outside the microphone. The horizontal branches arranged one above the other are substantially identical, wherein the upper branch in the Figure is associated with a first counterelectrode segment, in the center of which is arranged a second counterelectrode segment associated with the lower branch. As the lines are the same, only the structure of the upper line is discussed in detail hereinafter.

The capsule capacitance 640 of the counterelectrode segment of an annular configuration is diagrammatically shown at the left in the Figure. A regulatable polarization source voltage 61 is connected thereto for polarization of the condenser microphone. A switching device 62 is also provided at the output of the polarization source voltage 61. That switching device 62 possibly is or can be connected to the switching device of the branch therebeneath so that the signal flow through the branch or branches can be interrupted jointly or also independently of each other. Provided at the output of the switching device 62 is an adjustable or regulatable delay member 16 with which the signal passing through the branch can be delayed by an adjustable value. Such a delay can be used for example in connection with the signal passing through the second branch to produce a directional effect for the condenser microphone.

Connected to the delay member 16 at the output side there is in turn a filter 63. Depending on the respective application involved there can be a slight reduction in depths (for example first or second order high pass). In addition the arrangement can involve separation of the signals (frequency dividing arrangement) in the high and low range.

The output of the filter 63 is connected to the input of an amplifier 64 disposed in the branch. In the case of microphones the amplifier functions as an impedance converter (that is to say without amplification) so that here no increase in the signal-to-noise ratio is achieved.

The output-side lines of the amplifiers 64 of the two branches are brought together in an electric connecting device 65. The electric connecting device 65 can be for example a plug or jack arranged at the outside of the condenser microphone. In regard to ergonomic advantages the electric connecting device 65 can preferably be arranged at the underside of a microphone casing and can extend therefrom frequently in the substantially cylindrical body in the axial direction.

In the block circuit diagram shown in FIG. 12 the condenser microphone unit according to the invention ends downstream of the electric connecting device 65, to which an A/D converter 66, a signal processing unit 67 and a D/A converter 68 can be connected.

Figure 13:
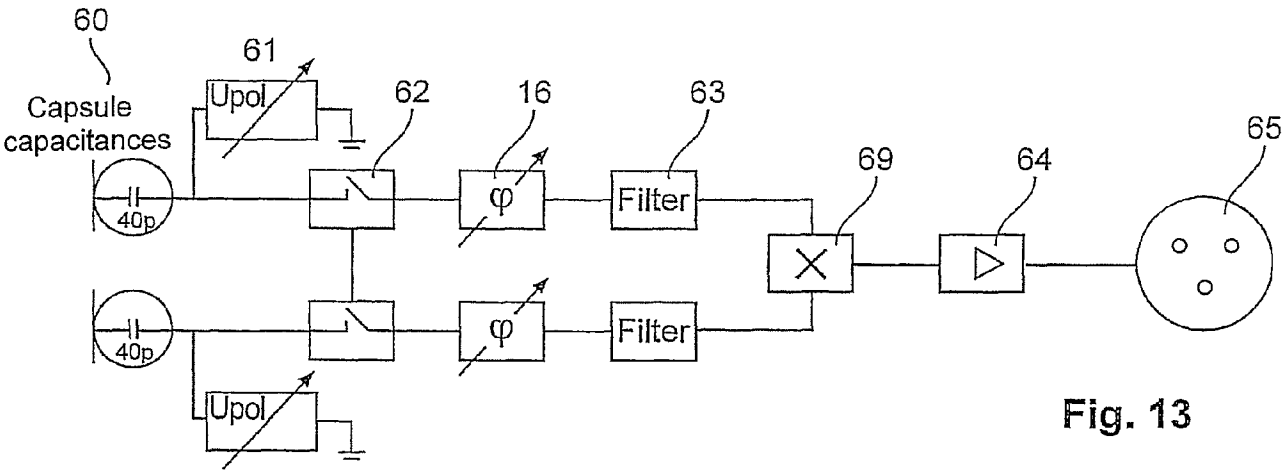
FIG. 13 shows a block circuit diagram of a condenser microphone according to an eleventh embodiment.

FIGS. 13 and 12 shows a stereo or twin-channel microphone, wherein signal processing is effected in part in the microphone. Additional processing can be effected for example on a digital level outside the microphone.

FIG. 13 shows a block circuit diagram of a condenser microphone according to an eleventh embodiment. The condenser microphone of FIG. 13 substantially corresponds to that of FIG. 12. Unlike the condenser microphone shown in FIG. 12 the two horizontal branches already divide downstream of the filter 63 at a mixing device 69 in which the signals coming from the counterelectrode segments and processed in accordance with the block circuit diagram can be combined together before they are applied to the output of the mixing device as a combined signal. At the output side at the mixing device 69 there is provided the input of a common amplifier 64 which essentially performs the function of the amplifier 64 discussed in relation to FIG. 12. The structure shown in FIG. 13 also ends with an electric connecting device 65 connected to the output of the amplifier 64. In comparison with the electric connecting device 65 shown in FIG. 12 the electric connecting device 65 of FIG. 13 has fewer connections, which is due in particular to the fact that the signals of the counterelectrode segments are already combined together within the condenser microphone. As already shown in FIG. 12 further processing of the signals can also be effected for example on a digital level in the microphone.

FIGS. 12 and 13 show a mono microphone, signal processing being effected in the microphone.

In an aspect of the present invention the above-described diaphragms are optionally suspended only at their outside, that is to say the diaphragms represent externally suspended diaphragms.

The microphones according to the invention are of a diameter of at least 0.5 inch (about 1.27 cm). In the case of microphones of that size effects can occur so that the diaphragm performs different oscillations at various positions on its surface.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

The invention claimed is:

1. An electroacoustic sound transducer comprising:
at least one diaphragm;
at least one counter-electrode;
a housing, where the counter-electrode is provided within the housing;
a rear volume between the counter-electrode and the housing; and
a front volume between the diaphragm and the counter-electrode;
wherein the counter-electrode has at least two mutually electrically insulated segments; and
wherein the segments of the counter-electrode are configured to be occupied with different electric signals or to output different electric signals;
wherein the rear volume is divided in various volumes corresponding to the number of segments of the counter-electrode;
wherein the rear volume has an opening having an acoustic resistance; and
wherein the front volume is subdivided corresponding to the number of segments of the counter-electrode.

2. The sound transducer as set forth in claim 1;
wherein the segments of the at least one counter-electrode are arranged on a surface that is towards the diaphragm.

3. The sound transducer as set forth in claim 1;
wherein the diaphragm has a diameter of ≥0.5 inch.

4. The sound transducer as set forth in claim 1;
wherein the segments of the counter-electrode are produced in the form of thin electrically conducting layers in the manner of a film.

5. The sound transducer as set forth claim 1;
wherein the segments of the counter-electrode are in the form of concentric circular disks, annular disks, or sectors of said shapes.

6. The sound transducer as set forth in claim 1;
wherein the segments of the counter-electrode are arranged in matrix form.

7. The sound transducer as set forth in claim 1;
wherein the segments of the counter-electrode are arranged on the counter-electrode; and
wherein the counter-electrode is produced on a carrier in the form of a molded interconnect device.

8. The sound transducer as set forth in claim 1;
wherein at least one segment of the counter-electrode is configured to act on the electric sound transducer with a correction signal.

9. A microphone comprising:
an electroacoustic transducer as set forth in claim 1.

10. An electroacoustic sound transducer comprising:
at least one diaphragm;
at least one counter-electrode;
a housing, where the counter-electrode is provided within the housing;
a rear volume between the counter-electrode and the housing; and
a front volume between the diaphragm and the counter-electrode;
wherein the diaphragm has at least two mutually electrically insulated segments; and
wherein the segments of the diaphragm are configured to be occupied with different electric signals or to output different electric signals;
wherein the rear volume is divided in various volumes corresponding to the number of segments of the diaphragm;
wherein the rear volume has an opening having an acoustic resistance; and
wherein the front volume is subdivided corresponding to the number of segments of the diaphragm.

* * * * *